US009034235B2

(12) United States Patent
Van Elten et al.

(10) Patent No.: US 9,034,235 B2
(45) Date of Patent: May 19, 2015

(54) METHOD FOR PRODUCING A WOOD WOOL CONSTRUCTION ELEMENT, A CONSTRUCTION ELEMENT OBTAINED THEREWITH AND A PRODUCTION FACILITY THEREFORE

(75) Inventors: Gerrit Jan Van Elten, Voorthuizen (NL); Paulus Elbertus Van Elten, Barneveld (NL); Elbertus Johannes Van Elten, Barneveld (NL)

(73) Assignee: THERMOFORM NEDERLAND B.V., Barneveld (NL)

( * ) Notice: Subject to any disclaimer, the term of this patent is extended or adjusted under 35 U.S.C. 154(b) by 0 days.

(21) Appl. No.: 13/096,463

(22) Filed: Apr. 28, 2011

(65) Prior Publication Data

US 2011/0229683 A1 Sep. 22, 2011

Related U.S. Application Data

(63) Continuation of application No. PCT/NL2009/000210, filed on Nov. 4, 2009.

(30) Foreign Application Priority Data

Nov. 4, 2008 (NL) ..... 2002167

(51) Int. Cl.
*B28B 1/52* (2006.01)
*B28B 1/16* (2006.01)

(52) U.S. Cl.
CPC .. *B28B 1/525* (2013.01); *B28B 1/16* (2013.01)

(58) Field of Classification Search
CPC ..... B28B 1/16; B28B 1/525; B29C 39/025; B32B 5/28
USPC ..... 264/109, 333; 249/117
See application file for complete search history.

(56) References Cited

U.S. PATENT DOCUMENTS

| | | | | |
|---|---|---|---|---|
| 2,271,066 | A * | 1/1942 | Ehrenhaft | 264/109 |
| 2,296,036 | A * | 9/1942 | Horn | 249/190 |
| 3,096,227 | A * | 7/1963 | Van Elten | 425/202 |
| 3,315,304 | A * | 4/1967 | Van Elten | 425/339 |
| 4,494,919 | A | 1/1985 | Knudson et al. | |
| 5,102,595 | A | 4/1992 | Tilby | |
| 2005/0193661 | A1 | 9/2005 | Van Elten | |
| 2008/0050556 | A1 | 2/2008 | Van Elten | |
| 2008/0152813 | A1 * | 6/2008 | Bowe et al. | 427/340 |

FOREIGN PATENT DOCUMENTS

| | | |
|---|---|---|
| GB | 146581 | 7/1920 |
| WO | WO 2006016844 | 2/2006 |

* cited by examiner

*Primary Examiner* — James Sanders
(74) *Attorney, Agent, or Firm* — Peacock Myers, P.C.; Jeffrey D. Myers

(57) ABSTRACT

A method for producing a wood wool construction element. This method comprises the steps of dispersing at least a part of a mixture of wood wool and a hydraulic binder in a mold so as to obtain a layer of the mixture with a height that is less than the height of side walls of said mold. Said mixture is at least partially hardened after which a subsequent layer of mixture is provided. The thickness of a construction element may well exceed 30 cm, for example 40 cm, 50 cm or even 60 cm. Also, an element obtained with such method is described, as well as a production facility.

14 Claims, 4 Drawing Sheets

METHOD FOR PRODUCING A WOOD WOOL CONSTRUCTION ELEMENT, A CONSTRUCTION ELEMENT OBTAINED THEREWITH AND A PRODUCTION FACILITY THEREFORE

CROSS-REFERENCE TO RELATED APPLICATIONS

This application is a continuation application of International Patent Application Serial No. PCT/NL2009/000210, entitled "A Method for Producing a Wood Wool Construction Element, a Construction Element Obtained Therewith and a Production Facility Therefore," to Thermoform Nederland B.V., filed on Nov. 4, 2009, which is a continuation of Netherlands Patent Application Serial No. 2002167, entitled "A Method for Producing a Wood Wool Construction Element, a Construction Element Obtained Therewith and a Production Facility Therefore," to Thermoform Nederland B.V., filed on Nov. 4, 2008, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a method for producing a wood wool construction element a construction element obtained therewith and a production facility therefore.

2. Description of Related Art

Such a method is known in the art, for example from the international patent application W02006/016844.

A disadvantage of this known method consists among others of the fact that the elements obtained do not have a constant density throughout their thickness. More specifically, the elements obtained according to the known method have a high density due to the compression of the fresh material under its own weight.

BRIEF SUMMARY OF THE INVENTION

The invention aims at alleviating or preventing these problems.

More in particular, the invention aims at providing an improved method.

The invention especially aims at providing an improved method wherein the product obtained has a more constant and lower density through its entire thickness.

The invention furthermore aims at providing a method wherein the elements can be easily provided with inlays without interrupting the internal structure of the construction element and without interrupting the production, for example the production capacity or production speed.

The invention also aims at providing an improved product.

Finally, the invention aims at providing a production facility to enable the method according to the invention.

BRIEF DESCRIPTION OF THE SEVERAL VIEWS OF THE DRAWINGS

Hereafter, a description of the invention with reference to the accompanying figures is given.

Figure 1:
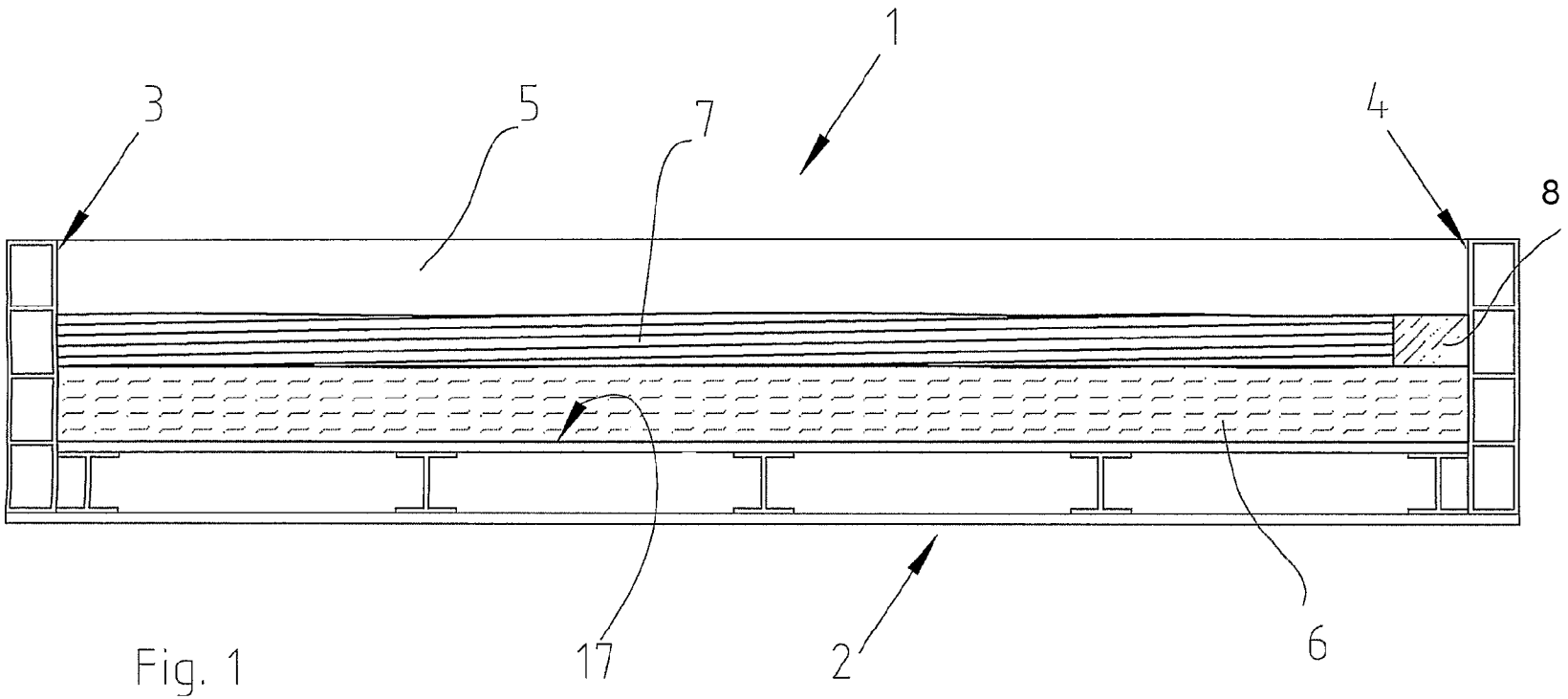
FIG. 1 shows a first embodiment of a mould for producing a construction element according to the invention.

In the figures, the same or equivalent parts are identified by the same reference numerals. Not all parts necessary for practicing the invention are identified in the figures or the description thereof; only the parts that need to be described to provide a sufficient understanding of the invention are specifically identified and described.

DETAILED DESCRIPTION OF THE INVENTION

To obtain at least one of the above mentioned goals, the present invention relates to a method, a construction element and a production facility as set forth in the specification and claims.

Preferred embodiments are identified in the dependent claims, which are hereby incorporated in the description by reference.

Wood wool that can be used advantageously in the present invention has a length of approximately 25 cm, or double these dimensions, depending on the machine producing the wood wool.

The width of the wood wool is preferably at least 1.0 mm and maximally 5.0 mm. Wood wool having a width of between 2 and 4 mm is especially preferred.

The thickness of the wood wool is at least 0.2 mm, preferably at least 0.3 mm and maximally 0.5 mm, preferably maximally 0.4 mm.

Generally, wood particles with dimensions of less than approximately 2 cm long are removed from the mixture preceeding adding the hydraulic binder to the wood wool mixture, since these do pollute the machinery and moulds and do not provide any substantial thermal insulating performance.

It is preferred to use wood wool that is curved or even curled in a spiral form. This means that the length of the wood wool fibres used may be approximately 25 cm when stretching same in a straight line, as outlined above. However, when they are curved or curled the distance from one end to the other end is less than 25 cm, preferably substantially less than 25 cm, for example less than 20 cm, more preferably less than 10 cm, like less than 5 cm. When dispersing such wood wool in a mould, an open structure is obtained showing good thermal insulating properties and a low density, for example less than 400 kg/m3, preferably less than 350 kg/m3, more preferably less than 300 kg/m3.

More in particular, it is preferred that at least 50% of the wood wool fibres, preferably at least 70% of the wood wool fibres, has an elongated length (X), for example 25 cm, wherein the distance from a first end to a second end of said part of the wood wool fibres placed in the mould is less than 70% of the elongated length (X) of the wood wool fibres, preferably is less than 50% of the elongated length (X) of the wood wool fibres, more preferably is less than 30% of the elongated length (X) of the wood wool fibres, most preferably is less than 10% of the elongated length (X) of the wood wool fibres.

The wood wool that is used in the method according to the present invention is wetted, so as to provide a good binding capacity with the hydraulic binder. The amount of water is sufficient for obtaining a complete setting of the hydraulic binder. The hydraulic binder may be cement, like Portland cement or the like, or another hydraulic binder that is capable of binding to wood. The international patent application WO 2006/016844 mentions on page 3, line 25 thru page 4, line 34 and further ("Method of Production") among others values of ratios of water to hydraulic binder and matching amounts of wood wool that can be adequately used in the present invention as well. These values, as well as the further details mentioned there regarding filling and emptying the moulds, are herewith incorporated by reference in the present description.

The elements according to the present invention can be stuccoed or the like after having been fully hardened, for example after they have been used as wall elements for erecting a building.

When incorporating a pillar into the elements, the same must be incorporated such that the pillar is positioned vertically when positioning the construction element in its position of use. Then, the construction element can be advantageously used as a wall element for erecting a building, for the pillar will bear vertical loads that originate from one or more floors and walls above and the roof construction. The pillar can be used for connecting thereto the floor, wall or roof element above it. Then, the wood wool part of the construction element will not have to bear any external loads and hence can be made of a low density so as to have high thermal insulating properties.

In this respect, it is to be noted that a construction element according to the present invention is most preferably used as a wall element, with a vertical height, a horizontal width and a horizontal thickness. The construction element is produced in a mould such that its height and width are outlined in a horizontal direction of the mould and that the horizontal thickness of the construction element is outlined in a vertical direction of the mould.

When producing construction elements in a preferred embodiment wherein at least two moulds are positioned substantially contiguous, the sidewalls of the moulds provide the upper and lower sides of the construction elements, respectively of the walls produced therewith.

A multiplicity of pillars can be incorporated in a construction element, for example at mutual distances of from 0.5 to 3 m, depending on the required load bearing capacity.

Along a side of the construction element a girder may be incorporated, for example of wood or concrete. This girder may be connected to the pillars for obtaining a structure with improved strength. Normally, the girder is provided at a topside of the construction element when in use. For example, this girder may be provisionally connected to a sidewall of the mould so as to immediately have the right position thereof. After dispersing and hardening the mixture of wood wool and hydraulic binder the provisional connection of the girder with the side wall of the mould may be removed. Naturally, the girder should have such a surface or surface finish that a good binding with the hydraulic binder is obtained. If in the erect positioned construction elements a ring beam of, optionally reinforced, concrete is preferred, a girder may be provided that is removed after hardening the mixture of wood wool and hydraulic binder. Then, after erecting the construction elements as a wall of a building, a reinforcement may be provided in the slot the girder has been removed from and concrete may be poured therein. This has the advantage that part of the concrete will fill the cavities between the wood wool so as to provide an intense connection of the concrete ring beam and the construction elements. This is also valid if in the vertical ends of the erect elements vertical slots are provided such that two adjacently positioned elements are lined out with those slots positioned against each other. Then, this slot can be filled with, optionally reinforced, concrete and/or a separate reinforcement for producing a pillar that at the same time holds the adjacent elements firmly together. If at the same time a ring beam is provided, the pillar can be connected to the ring beam so as to provide a further increased strength.

As mentioned above, a mould may comprise four sidewalls, hence producing a rectangular, or equivalent, construction element. Each mould will then produce a construction element, wherein cutting is not required.

According to a further embodiment, when using the embodiment of substantially contiguous moulds, such moulds will have oppositely positioned sidewalls only, which extend in a longitudinal direction.

Although there is mention of mixture of wood wool and hydraulic binder in the above description, it should be clear to a person skilled in the art that said mixture comprises an amount of water as well, sufficient to provide an adequate binding capacity and setting of the hydraulic binder fully.

FIG. 1 shows a cross-section of a mould according to a first embodiment of the invention, wherein a mould 1 is comprised of a bottom 2 and two opposing side walls 3, 4, as well as two opposing end walls 5 (only one is shown). The bottom 2 is made of a construction such that it provides sufficient rigidity and strength to the mould 1. A first layer 6 of a mixture of wood wool and hydraulic binder is positioned in the mould 1. The first layer 6 fills the mould 1 only partially. A pillar 7 is placed on top of this first layer 6. Along one sidewall 4, a beam 8 (optionally more than one beam) is placed, such that it is substantially surrounded at three sides by said mixture. The fourth side of said beam 8 lies against the sidewall 4. The pillar 7 is positioned adjacent a side of said beam 8, preferably over its entire length.

Although not shown in FIG. 1, a further layer of mixture is positioned on top of said first layer 6, pillar 7 and beam 8, to a height exceeding the top of the sidewalls. Then a second mould 1, generally identical to the mould 1 shown in the figure, or a lid (not shown) can be placed on top of the mould 1 as shown, so as to compress the mixture in this mould 1 to a height identical to the height of the walls 3, 4, 5.

After hardening out sufficiently the top mould or lid can be removed after which the construction element can be removed from the mould 1.

Figure 2:
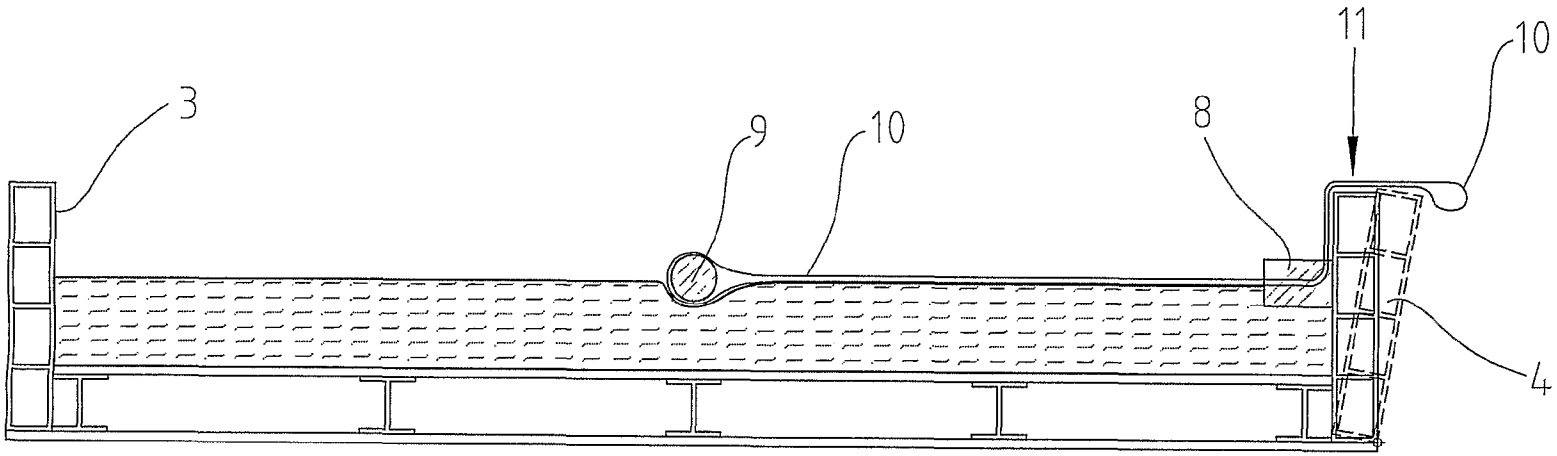
FIG. 2 shows a second embodiment of a mould for producing a construction element according to the invention.

A further embodiment of the invention is shown in FIG. 2, showing a mould having oppositely positioned longitudinal sidewalls 3, 4 only. One sidewall 4 can be connected hingedly to the bottom 2 of the mould 1. After the construction element is hardened out sufficiently, the sidewall 4 can be hinged away from the construction element, after which the construction element can be removed easily from the mould 1. The distance, over which the sidewall 4 is moved, should preferably be such that the element can be hoisted out of the mould 1. As a further embodiment, the sidewall 4 is hinged over at least 90°, after which the element can be pulled out of the mould (in the Figure, to the right; i.e. in the same direction as the straps in the element).

So as to be able to easily pull out the element from the mould, an elongate element 9, for example a beam, which can be a short piece of wood, is positioned in the mould 1 on top of a layer 6 of mixture of wood wool and hydraulic binder (perpendicular in the plane of FIG. 2). It can be positioned in the same plane as the pillar 7, shown in FIG. 1, for example between two substantially parallel placed pillars 7. A hoist strap 10 is placed around the beam 9 and is directed to the side of the side wall 4, preferably guided through a girder (top beam) 8 and is then guided out of the mould 1 over the top 11 of the side wall 4. The girder 8 preferably extends over the entire length of the sidewall 4. The girder 8 spreads out forces that are exerted thereon when pulling the strap 10 at an angle, over the entire length of the construction element. The strap 10 can also be used for handling the construction element after is has been taken out of the mould 1, for hoisting and loading and when using same for erecting the walls of a building or the like.

Figure 3:
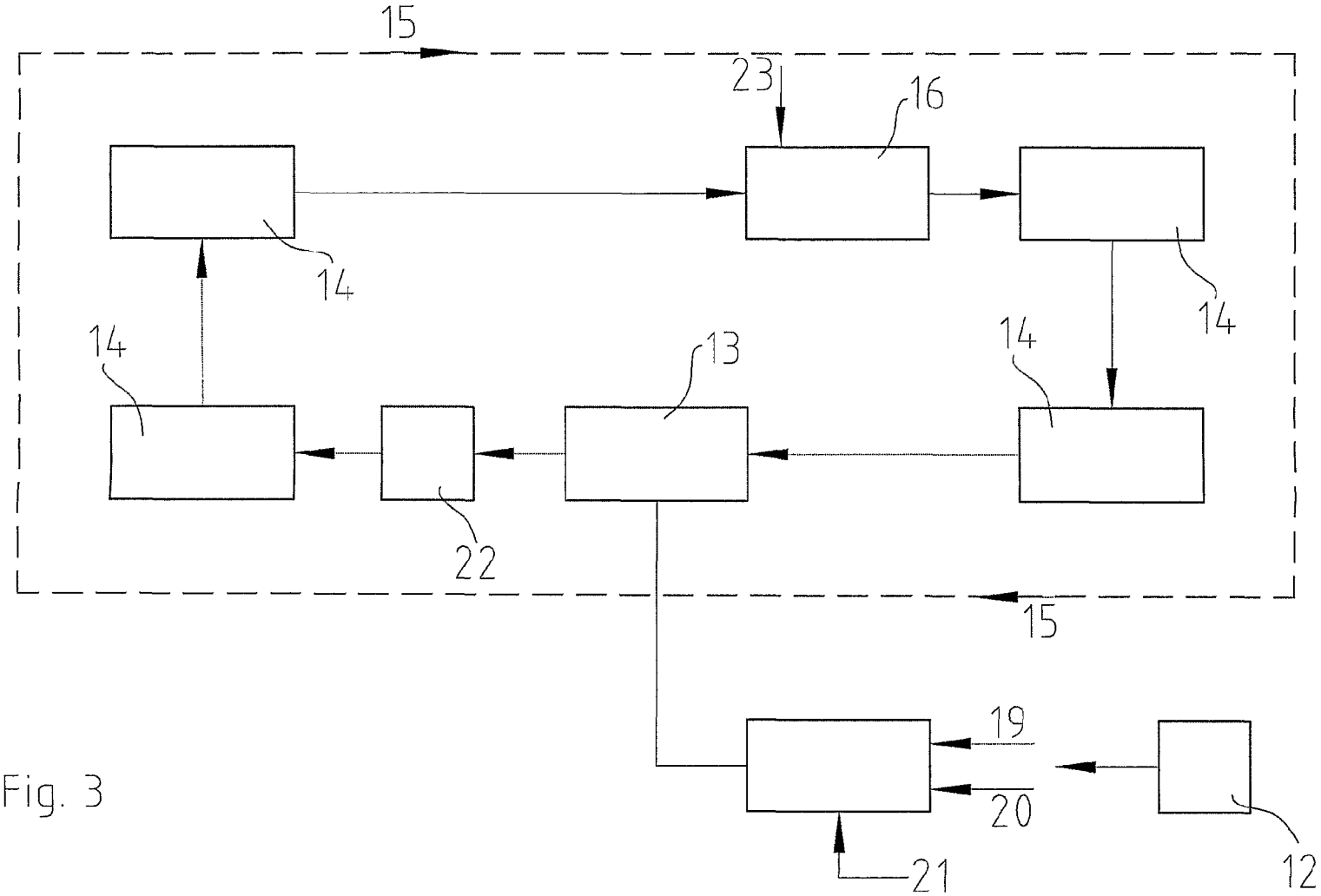
FIG. 3 shows a simplified scheme of a production facility according to the invention for transporting moulds in a loop.

FIG. 3 shows a diagrammatical flow chart of a production line according to the invention. It is comprised of a wood wool production facility 12, for example an Eltomatic machine, well known in the art. A mixture of wood wool 19, water 20 (optionally with some additions as commonly known in the art) and hydraulic binder 21 is provided to a distributor 13, for distributing the mixture over a width substantially equal to the width of a mould 14. Here, a row of adjacently positioned moulds 14 is transported through the distributor so as to continuously distribute said mixture in adjacently and successively transported moulds. Thereafter, the moulds 14 are in a continuous fashion transported to a saw 22, cutting the mixture that was added into the mould by the distributor, at both ends of said mould so as to obtain a series of moulds each comprising a layer of mixture that is separated from the layers of successively positioned moulds. Then the mould 14 is further transported in the loop 15. In this loop 15, a filling station 16 is provided so as to optionally add an inlay 23. This inlay may be as described above. Adding the inlay may be performed by hand or automatically. Then, the moulds are in a continuous fashion returned to the distributor to add a further layer of mixture on top of the previously added layer of mixture and the optionally added inlay.

As a matter of fact, the diagrammatical flow chart in FIG. 3, may roughly be a good representation of a real production facility.

Figure 4:
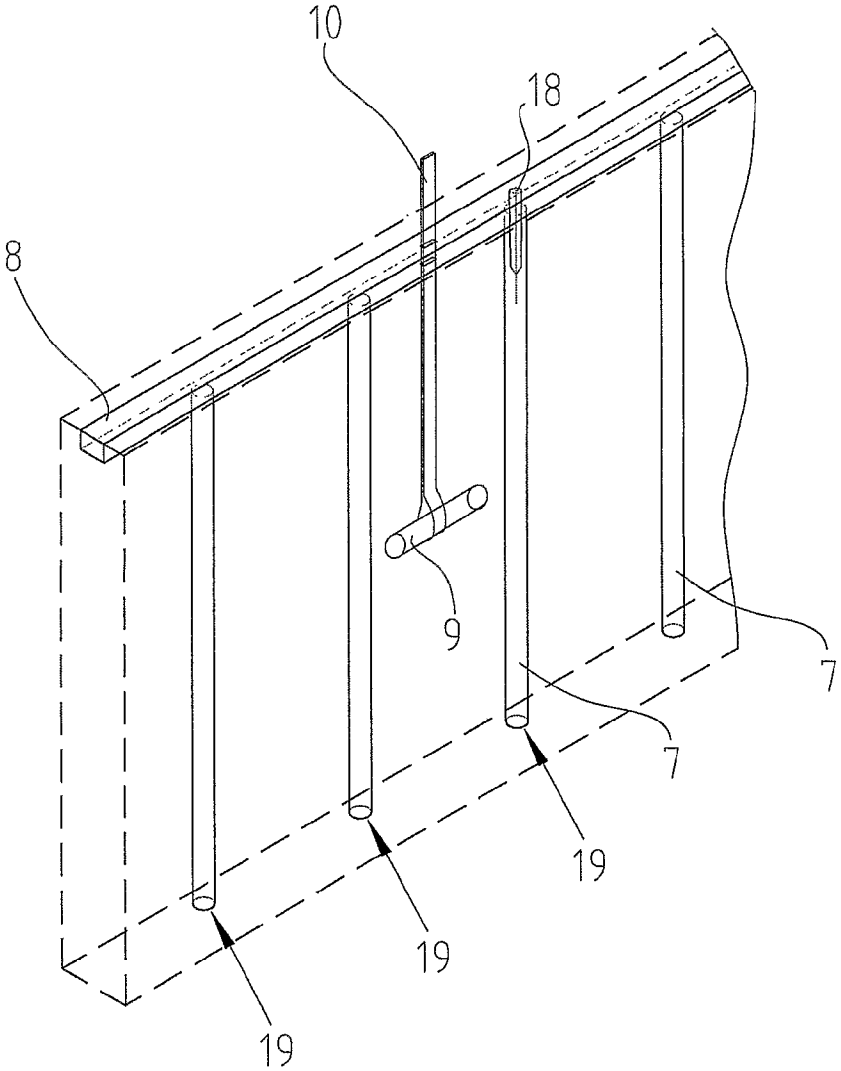
FIG. 4 shows a schematic perspective ghost view of a construction element according to the invention.

FIG. 4 shows an outline of a construction element obtained according to the invention. The mixture of wood wool and hydraulic binder is omitted for clarity. A girder 8 and pillars 7 are clearly visible, as well as the strap 10 and the beam 9. The girder can be connected to the pillars by means of connecting elements 18 (only one is shown). This connection can be made when positioning the said items in the mould or after the elements have been taken out of the mould. Furthermore, it is clear from the embodiment in this Figure, that the strap is guided through a hole in the girder. The ends 19 of the pillars are flush with the bottom wall of the construction element. In this respect, it is clear that the bottom side of the construction element according to the invention, on which it rests when in use, should be perpendicular with respect to its sides. For, if the edges of the bottom side are not perpendicular, the construction element may fall over. Hence, referring to FIGS. 1 and 2, the sidewall 3 of the mould 1 should be at a right angle with respect to the bottom wall 17 of the mould 1.

The other sidewall 4 and the optional end wall 5 may be positioned at an obtuse angle with respect to the bottom wall 17 so as to facilitate the removal of the construction element from the mould 1.

The wood wool is preferably obtained by using an Eltomatic Rotating Wood Wool Machine, as known in the art. This machine, including the mixer for obtaining the mixture of wood wool, binder and water is known to skilled men in the art throughout the world.

The production facility for producing the construction element according to the present invention and for performing the method according to the present invention, comprises: means for providing and dispersing the mixture, at least one mould with four sides or a series of consecutive moulds with only two longitudinal sides each, optionally means for supplying stucco and positioning girders, pillars, barriers, boards, beams or straps and the like. Additionally, it may comprise transporting means for repeatedly transporting said moulds to and from said dispersion means, for at least twice dispersing a mixture of wood wool and cement into said mould. It may also comprise hardening means for hardening said mixture at least partially in between two dispersion steps. These hardening means may comprise a hardening tunnel and/or a storage station or may just be comprised of the transporting means, wherein said at least partial hardening takes place during transporting the moulds.

Preferably, hardening of the mixture in between two dispersion steps is sufficient to obtain a hardening such that the layer does not settle more than 50%, preferably not more than 25%, more preferably not more than 10%. The term "settle" means the difference in height of a first layer of mixture before and after dispersing a subsequent layer of mixture thereon.

Preferably, if an inlay consisting of a board or another relatively heavy material is placed on a layer of mixture, spacers may be provided for carrying said inlay, so as to prevent an unwanted compression of the layer of mixture.

Some overfilling of the mould with mixture may be required to slightly compress the mixture by placing a lid or another mould thereon. The mould should be filled completely; however, compressing the mixture in the mould should be as little as possible. Overfilling may comprise a height of mixture above the mould of maximally 10 cm, preferably maximally 5 cm, more preferably maximally 4 cm, most preferably maximally 2 cm. Hence, if the side walls of the mould have a height of 50 cm, the total height of the layer of mixture in the mould, before placing the lid or another mould thereon, is maximally 60 cm, preferably maximally 55 cm, or more preferably maximally 54 cm, most preferably maximally 52 cm.

It may be preferred to compress a firstly added layer in the mould so as to obtain a first layer with an increased density and rigidity.

It may be preferred to add an inlay in the mould before adding a first layer of mixture. Such an inlay may be comprised of stucco or a board, for example an Eltoboard™ or the like so as to at least partly, optionally completely or substantially completely, cover the outer wall of a construction element. As a matter of fact, a gap between boards can be provided, if wanted or required. Optionally, both walls or one or the other wall of a construction element may be covered by adding a board at any of the down side and/or top side of the mould.

What is claimed is:

1. A method for producing a wood wool construction element, comprising the steps of:

a) providing a mould having a bottom and at least two side walls, preferably two oppositely placed side walls;

b) providing a mixture of wood wool and a hydraulic binder;

c) dispersing at least a part of said mixture in the mould so as to provide a layer of the mixture, said layer having a height that is less than the height of the side walls;

d) at least partially hardening said mixture dispersed during step c) in the mould;

e) repeating steps c) and d) with the provision that a final layer of mixture is added in step c) when the total height of the mixture in the mould exceeds the height of the side walls of the mould, with the proviso that after partially hardening said mixture dispersed during at least one step c) such that a subsequently dispersed layer of said mixture provides a settlement of less than 50% and before performing a subsequent step of dispersing another part of said mixture, a pillar is placed in the mould, said pillar extending, between two opposed side walls or between a side wall and a beam positioned against an opposite side wall; and f) positioning a cover on top of the mould so as to compress the mixture in said mould with a bottom side of said cover to a height substantially equal to the height of the side walls of the mould, and hardening the mixture.

2. A method according to claim 1, wherein the mixture of wood wool and hydraulic binder comprises an amount of water that is sufficient for binding said hydraulic binder so as to obtain a wood wool construction element of mutually connected wood wool fibres.

3. A method according to claim 1, wherein the height of the sidewalls is between 20 and 60 cm.

4. A method according to claim 1, wherein the distance between side walls is at least 120 cm and maximally 350 cm.

5. A method according to claim 1, wherein at least two moulds are positioned substantially contiguous and are provided with mixture in step c) substantially successively, and wherein longitudinal side walls of adjacent moulds are lined out with each other.

6. A method according to claim 5, wherein the layer of mixture added in step c) is cut in between adjacent moulds, so as to obtain separate moulds each comprising a layer of said mixture.

7. A method according to claim 6, wherein the mixture is at least partially hardened after cutting same.

8. A method according to claim 1, wherein an inlay is placed on a layer of said mixture after step c) or step d).

9. A method according to claim 1, wherein any of the following combination of steps is performed:

an inlay is placed in the mould in between step b) and step c);

an inlay is placed in the mould in between step e) and step f); and an inlay is placed in the mould in between step b) and step c) and in between step e) and step f).

10. A method according to claim 8, wherein said inlay is comprised of at least one of a damp proof course, a reinforcing layer, an isolating layer, a girder, and a hoisting means.

11. A method according to claim 10, wherein said hoisting means comprises an elongate element substantially parallel to and at a distance from a side wall and a lifting strap connected with said elongate element and extending towards and out of the mould along said side wall.

12. A method according to claim 10, wherein said pillar extends between two opposed side walls, or between a side wall and a beam positioned against an opposite side wall, wherein said pillar is positioned vertically so as to be able to withstand vertical bearing loads.

13. A method according to claim 9, wherein at least one side wall is hingedly connected to the bottom, and said hingedly connected side wall is hinged out after step f) for allowing the construction element to be removed from the mould.

14. A method according to claim 1, wherein at least 50% of the wood wool fibers have an elongated length (X), wherein the distance from a first end to a second end of said part of the wood wool fibres placed in the mould is less than 70% of the elongated length (X) of the wood wool fibers.

* * * * *